US005702291A

United States Patent [19]

Isobe

[11] Patent Number: 5,702,291

[45] Date of Patent: Dec. 30, 1997

[54] WAFER POLISHING METHOD AND WAFER POLISHING APPARATUS

[75] Inventor: Akira Isobe, Tokyo, Japan

[73] Assignee: NEC Corporation, Tokyo, Japan

[21] Appl. No.: 734,554

[22] Filed: Oct. 21, 1996

[30] Foreign Application Priority Data

Oct. 19, 1995 [JP] Japan ..... 7-294946

[51] Int. Cl.[6] ..... B24B 1/00

[52] U.S. Cl. ..... 451/41; 451/285; 451/286; 451/287; 451/289; 451/41; 451/60; 451/443; 451/446

[58] Field of Search ..... 451/41, 285–289, 451/443, 60, 446

[56] References Cited

U.S. PATENT DOCUMENTS 5,154,021 10/1992 Bombardier et al. .
5,308,438 5/1994 Cote et al. .
5,545,076 8/1996 Yun et al. ..... 451/285

FOREIGN PATENT DOCUMENTS 0 581 350 2/1994 European Pat. Off. .
0 589 434 3/1994 European Pat. Off. .
677189 3/1994 Japan .

*Primary Examiner*—Robert A. Rose
*Assistant Examiner*—George Nguyen

[57] ABSTRACT

In a polishing method of polishing a surface of a wafer by pressing the wafer, which is rotating in the same direction as a rotating table, against the polishing table while continuously flowing a polishing agent onto the polishing table, run-off of the polishing agent is suppressed by continuously blowing air from the outside of the polishing table toward the polishing table. A wafer polishing apparatus for practicing the above method includes a polishing table having rotating means, polishing agent supplying means for supplying a polishing agent onto the polishing table, wafer holding means, having rotating means and vertical drive mechanism, for holding a wafer to oppose the polishing table, and air blowing means for blowing air from the outside of the table polishing toward the polishing table. According to this method and apparatus, run-off of the polishing agent is suppressed appropriately, so that run-off of the polishing agent is decreased when compared to a conventional case without causing degradation of the polishing agent due to retention of the polishing agent, thereby decreasing the running cost of CMP.

6 Claims, 4 Drawing Sheets

WAFER POLISHING METHOD AND WAFER POLISHING APPARATUS

BACKGROUND OF THE INVENTION

1. Field of the Invention

The present invention relates to a wafer polishing method and an apparatus therefore and, more particularly, to a polishing method called chemical mechanical polishing (CMP) for polishing the surface of a wafer by using a polishing agent and an apparatus therefore.

2. Description of the Prior Art

In recent years, due to the trend for larger-scale, multifunctional, and micropatterned semiconductor devices, the wiring layers and interlayers stacked to form an advanced wiring structure are increasing in number and becoming complicated, and the unevenness and corrugation of the wafer surface are becoming large accordingly. If a large step exists on the wafer surface, step coverage (coverage on the step portion of an aluminum wiring layer) and the precision in photolithography are degraded. Then, the yield is decreased, making it difficult to obtain a highly reliable product. Therefore, it is demanded to smooth and flatten the wafer surface, and in particular the surface of an insulating interlayer. Various types of techniques are proposed and put into practical use for this purpose. An example of such techniques includes a chemical mechanical polishing method of polishing the wafer surface by using a polishing agent. In this specification, note that a "wafer surface" includes not only the mirror surface of the wafer itself but also the surface of a thin film (a metal thin film insulating film) formed on the wafer in the step of forming devices on a wafer.

FIG. 1A is a sectional of a polishing apparatus 21 employing the conventional chemical mechanical polishing method, and FIG. 1B is a plan view of the polishing apparatus 21 shown in FIG. 1A.

As shown in FIGS. 1A and 1B, in the conventional polishing apparatus 21, while a polishing agent 3 is supplied onto the polishing table 2 from a polishing agent supply nozzle 4 arranged above the central portion of a polishing table 2 to which a polishing pad 1 (made of, e.g., rigid foamed polyurethane) is adhered, a wafer (not shown) mounted on the surface of a rotating wafer holding portion 5 opposing the polishing pad 1 is pressed against the rotating polishing table 2, thereby performing polishing.

Supply of the polishing agent 3 is started 15 seconds before the start of polishing and is continued during polishing. The flow rate of the polishing agent 3 is 200 cc/min. As the polishing agent 3, alkaline colloidal silica slurry obtained by mixing 0.01-μm diameter highly pure silicon dioxide, i.e., a silica powder in an alkali solution is used.

FIG. 2 is an enlarged sectional view of the wafer holding portion 5 of the polishing apparatus 21 shown in FIGS. 1A and 1B.

The structure of the wafer holding portion 5 is obtained by fixing a retainer ring 8 for holding a wafer 7 during polishing to the periphery of a stage portion 9 constituting the main body of the wafer holding portion 5, and adhering a pad 10 (made of, e.g., foamed polyurethane) inside the retainer ring 8, as shown in FIG. 2. Pressurizing/vacuum suction holes 11 for drawing the wafer 7 by vacuum suction or pressurizing the wafer 7 with compressed air from the reverse side of the wafer 7 are formed in the stage portion 9 and the pad 10. During polishing, the wafer 7 is pressurized through the pressurizing/vacuum suction holes 11 in order to uniform the polishing load on the entire surface of the wafer 7, so that a decrease in polishing rate at the central portion of the wafer 7 is compensated for (this will be described later in detail). Vacuum suction is performed when picking up the wafer 7 with the wafer holding portion 5 at the start of polishing or moving the wafer 7 upward from the polishing table 2 while the wafer 7 is kept held by the wafer holding portion 5 after the end of polishing.

The polishing table 2 and the wafer holding portion 5 are rotated at 20 rpm in the same direction and a load of 7 PSI (Pounds Square Inch) (492 g/cm$^2$) is applied to the polishing tabel 2, thereby polishing the surface of the wafer 7 and flattening the corrugation.

With this conventional polishing method, however, as the polishing table 2 rotates, the polishing agent 3 undesirably runs off outside the polishing table 2. When the polishing agent 3 becomes short, not only the polishing speed is decreased, but also a scratch can be easily formed on the surface of the wafer 7 and the frictional force of the polishing pad 1 against the wafer 7 is increased, posing problems such as slipping out of the wafer 7 from the wafer holding portion 5. For this reason, during polishing, the polishing agent 3 must be kept supplied at a predetermined flow rate or more. However, since the polishing agent 3 is generally expensive and cannot be recovered and recycled, the running cost of the polishing apparatus 21 is increased.

To prevent run-off of the polishing agent 3, a fence 12 may be formed on the periphery of the polishing table 2, as shown in FIG. 3. With this method, however, the polishing agent 3 stays within the fence 12. As the number of polished wafers increases, the polishing agent 3 is degraded, so that the polishing characteristics are changed. As a countermeasure for this, the polishing agent may replaced every time polishing is completed. For example, an opening/closing mechanism 13 for vertically moving a fence 12 may be provided, as shown in FIG. 4, thereby discharging the polishing agent. However, the mechanism becomes complicated, and the processing time is prolonged.

As described above, flattening of the surface of the insulating interlayer by polishing has become popular. However, in polishing of the surface of the insulating interlayer, control of the polishing amount is more significant than in mirror surface polishing of the wafer. More specifically, when performing mirror surface polishing, although small corrugation on the surface poses a problem and finishing requires high precision on the order of Å, control of the polishing amount itself on the order of microns suffices. In contrast to this, when flattening an insulating interlayer, since the thickness of the insulating interlayer is determined by the polishing amount, control must be performed on the order of 0.1 micron or less. Therefore, the uniformity of the polishing amount within the surface of the wafer 7 also requires high precision, and various types of polishing parameters must be optimized. Theoretically, if the rotation speed of the polishing table 2 is set equal to that of the wafer 7, the relative speeds within the surface of the wafer 7 are all equalized. Thus, uniform polishing can be realized within the surface of the wafer 7 by applying a uniform load.

In practice, however, sufficient uniformity cannot be obtained with the above countermeasure. This is because the distribution of the amount of polishing agent 3 present between the wafer 7 and the polishing pad 1 also influences the distribution of the polishing amount within the surface of the wafer 7. As the polishing agent 3 present between the wafer 7 and the polishing pad 1 is swept by the wafer 7, it tends to be insufficient at the central portion of the wafer 7, so that the polishing rate at the central portion of the wafer 7 decreases. For this reason, air pressurizing method described above from the reverse side of the wafer 7 for the purpose of relatively increasing the load at the central portion of the wafer 7 and the like are employed. More specifically, this aims at compensating for a decrease in polishing rate caused by the shortage of the polishing agent 3 at the central portion of the wafer 7 by the load. However, the shortage of the polishing agent 3 at the central portion of the wafer 7 changes depending on the surface states of the polishing pad 1 and wafer 7. Therefore, with the method of changing the distribution of the load within the surface of the wafer 7, it is difficult to obtain stable uniformity.

SUMMARY OF THE INVENTION

It is the first object of the present invention to decrease run-off of a polishing agent in chemical mechanical polishing (CMP) of polishing the wafer surface by using the polishing agent, thereby decreasing the running cost of CMP.

It is the second object of the present invention to uniformly distribute the polishing agent on the wafer surface in CMP, thereby uniforming the polishing amount within the surface of the wafer.

In order to achieve the above objects, according to the present invention, there is provided a polishing method of polishing a surface of a wafer by pressing the wafer, which is rotating in the same direction as a polishing table, against the polishing table while continuously flowing a polishing agent onto the polishing table, comprising suppressing run-off of the polishing agent by continuously blowing air from an outside of the polishing table toward the polishing table.

According to this method, run-off of the polishing agent is suppressed appropriately, so that run-off of the polishing agent is decreased when compared to a conventional case without causing degradation of the polishing agent due to retention of the polishing agent, thereby decreasing the running cost of CMP.

According to another embodiment of the present invention, distribution of the polishing agent on the polishing table can be controlled by adjusting a flow rate of the polishing agent and a strength of air to be blown. Therefore, in CMP, the polishing agent is uniformly distributed on the wafer surface, so that the polishing amount within the wafer surface can be uniformed.

Furthermore, in the polishing method of the present invention, if supply of the polishing agent onto the polishing table is started in advance, and pressing of the wafer against the polishing table and blowing of air are started almost simultaneously, the polishing agent can be spread over the polishing table before starting polishing. Then, inconveniences such as formation of a scratch on the surface of the wafer due to the shortage of the polishing agent will not be caused, and polishing can be started at a stable polishing state.

A wafer polishing apparatus according to the present invention comprises a polishing table having rotating means, polishing agent supplying means for supplying a polishing agent onto the polishing table, wafer holding means, having rotating means and a vertical drive mechanism, for holding a wafer to oppose the polishing table, and air blowing means for blowing air from an outside of the polishing table toward the polishing table.

According to this polishing apparatus, run-off of the polishing agent is suppressed appropriately, so that run-off of the polishing agent is decreased when compared to a conventional case while preventing degradation of the polishing agent due to retention of the polishing agent. Therefore, an apparatus in which running cost of CMP can be decreased can be provided with a comparatively simple arrangement.

In the polishing apparatus according to the present invention, if the air blowing means has blowing air amount control means and/or air blowing angle control means, the distribution of polishing agent on the polishing table can be controlled to a desired state. Thus, the polishing agent can be effectively centralized on the wafer, and the stability of polishing can be improved.

Furthermore, if the air blowing means has a blowing port with a distal end portion which is formed flat, the air can be blown more effectively onto the polishing table.

DETAILED DESCRIPTION OF PREFERRED EMBODIMENTS

Figure 1A:
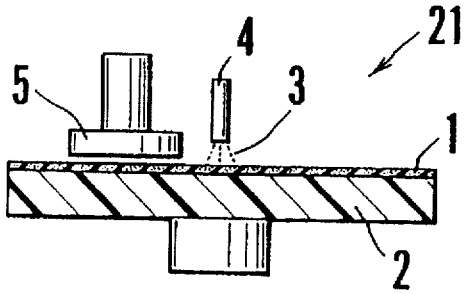
FIG. 1A PRIOR ART
FIG. 1A is a sectional view of a polishing apparatus employing a conventional chemical mechanical polishing method.
Figure 1B:
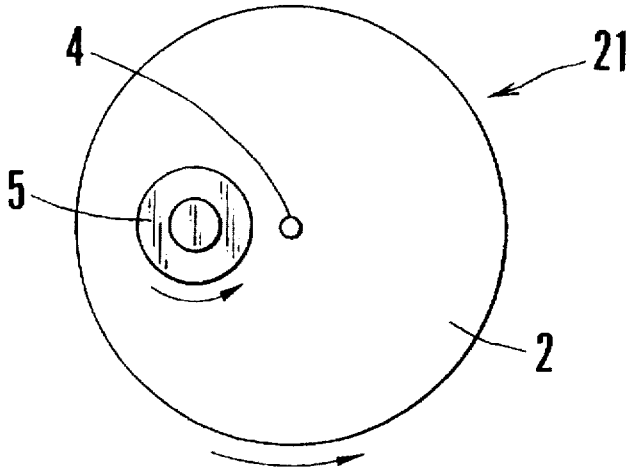
FIG. 1B PRIOR ART
FIG. 1B is a plan view of the polishing apparatus shown in FIG. 1A.
Figure 2:
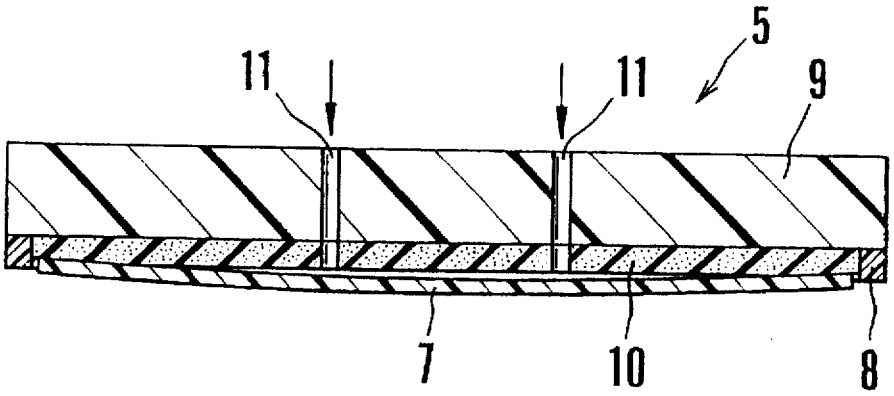
FIG. 2 PRIOR ART
FIG. 2 is an enlarged sectional view of the wafer holding portion of the polishing apparatus shown in FIGS. 1A and 1B.
Figure 3:
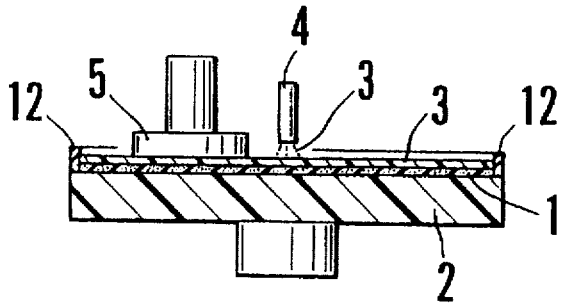
FIG. 3 PRIOR ART
FIG. 3 is a sectional view showing an improvement over the conventional polishing apparatus.
Figure 4:
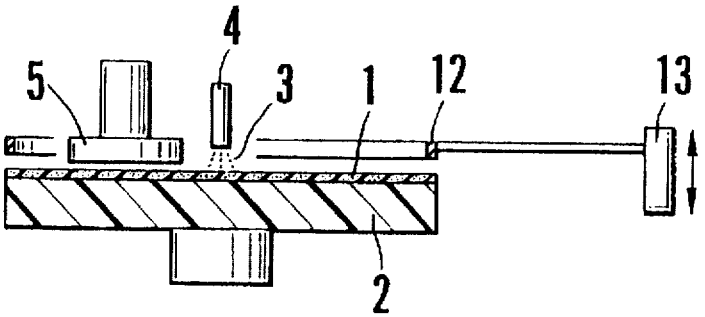
FIG. 4 PRIOR ART
FIG. 4 is a sectional view showing another improvement over the conventional polishing apparatus.
Figure 5:
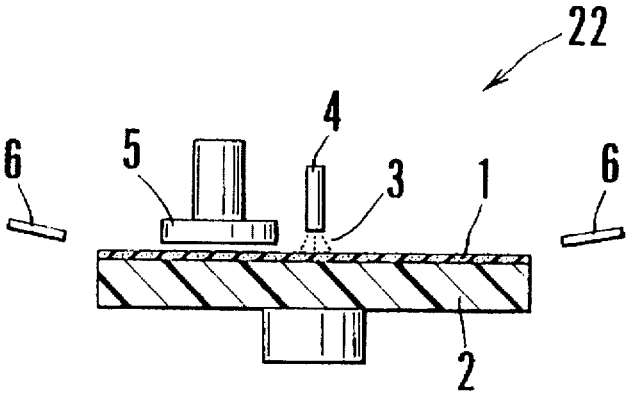
FIG. 5 is a sectional view of a polishing apparatus according to first embodiment of the present invention.
Figure 6:
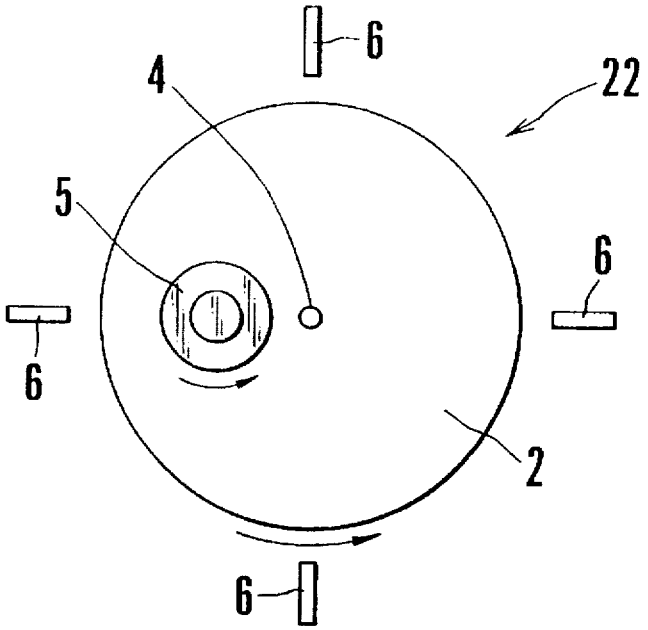
FIG. 6 is a plan view of the polishing apparatus shown in FIG. 5.

The preferred embodiments of the present invention will be described with reference to the accompanying drawings, FIG. 5 is a sectional view showing a polishing apparatus according to the first embodiment of the present invention, and FIG. 6 is a plan view of the same, A polishing apparatus 22 according to this embodiment has a polishing table 2 to which a polishing pad 1 is adhered, a polishing agent supply nozzle 4 arranged above the central portion of the polishing table 2 to supply a polishing agent 3, and a wafer holding portion 5 having a rotary mechanism and a vertical drive mechanism, in the same manner as the conventional apparatus. Also, four gas blow-off nozzles 6 are provided around the polishing table 2. The gas blow-off nozzles 6 are arranged outside the polishing table 2 by, e.g., 10 cm, to be directed to the center of the polishing table 2. The angles of the nozzles 6 are adjusted such that the extension lines of the axes of the nozzles 6 intersect the polishing table 2 at positions inside the circumference of the polishing table 2 by 2 cm. The arrangement of the wafer holding portion 5 is the same as that shown in FIG. 2, and a description thereof will be omitted.

The first polishing method using this polishing apparatus 22 will be described.

First, while the polishing table 2 is rotated at 20 rpm counterclockwise when seen from the above, supply of the polishing agent 3 at a flow rate of 200 cc/min is started 15 seconds before the start of polishing. This aims at spreading the polishing agent 3 over the polishing table 2. Subsequently, the wafer holding portion 5 holding a wafer (not shown) is moved downward while it is rotated in the same direction as the polishing table 2, and polishing is started. Simultaneously with the start of polishing, air is blown through the gas blow-off nozzles 6, and simultaneously the supply amount of polishing agent 3 is decreased to 50 cc/min.

Figure 7:
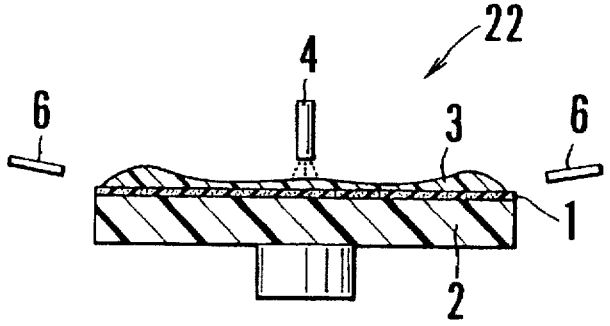
FIG. 7 is a sectional view for explaining the first polishing method using the polishing apparatus according to the first embodiment.

FIG. 7 schematically shows the distribution of the polishing agent 3 on the polishing table 2 obtained when the first polishing method is performed by using the polishing apparatus 22, in which the distribution of height of the polishing agent 3 on the polishing table 2 is emphasized. The air blowing strength from the gas blow-off nozzles 6 changes in accordance with the flow rate of air and the shapes of the nozzles. In this embodiment, the flow rate of air and the shapes of the nozzles are adjusted so that the distribution of the polishing agent 3 as shown in FIG. 7 is obtained.

When air is blown by the gas blow-off nozzles 6 onto the polishing agent 3 on the polishing table 2 from the outside of the polishing table 2 toward the polishing table 2, the polishing agent 3 present on the peripheral portion of the polishing table 2 is slightly blown toward the center of the polishing table 2, so that run-off of the polishing agent 3 to the outside of the polishing table 2 can be suppressed. Accordingly, although the supply amount of polishing agent 3 after the start of polishing is greatly decreased when compared to the conventional case, the amount of polishing agent 3 existing on the polishing table 2 is substantially equal to that in the conventional case. Assuming that polishing is performed for 4 min, the amount of polishing agent 3 which is conventionally required as 850 cc can be decreased to 250 cc in this embodiment. In this embodiment, the reverse side of the wafer must be pressurized during polishing, in the same manner as in the conventional case.

The polishing table 2 and the wafer holding portion 5 may be rotated in the same direction. Although the polishing table 2 and the wafer holding portion 5 are rotated counterclockwise in this embodiment, they can be rotated clockwise. This applies to any of the following embodiments.

The second polishing method using the polishing table 2 shown in FIGS. 5 and 6 will be described.

Figure 8:
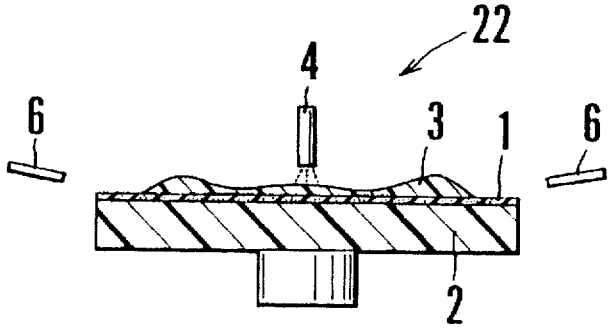
FIG. 8 is a sectional view for explaining the second polishing method using the polishing apparatus according to the first embodiment.

First, while the polishing table 2 is rotated at 20 rpm counterclockwise when seen from the above, supply of the polishing agent 3 at a flow rate of 200 cc/min is started 15 seconds before the start of polishing. This aims at spreading the polishing agent 3 over the polishing table 2. The wafer holding portion 5 holding a wafer (not shown) is moved downward while it is rotated in the same direction as the polishing table 2, and polishing is started. Simultaneously with the start of polishing, air is blown through the gas blow-off nozzles 6, and simultaneously the supply amount of polishing agent 3 is decreased to 50 cc/min. At this time, the air blowing strength is set higher than in the first embodiment to obtain the distribution of the polishing agent 3 as shown in FIG. 8. Then, the polishing agent 3 is largely distributed at a portion corresponding to the central portion of the wafer where the polishing agent 3 is not easily supplied, i.e., at the intermediate portion of the radius of the polishing table 2, and thus a sufficient amount of polishing agent 3 is supplied up to the central portion of the wafer. Therefore, the wafer need not be pressurized from its reverse side during polishing.

Figure 9:
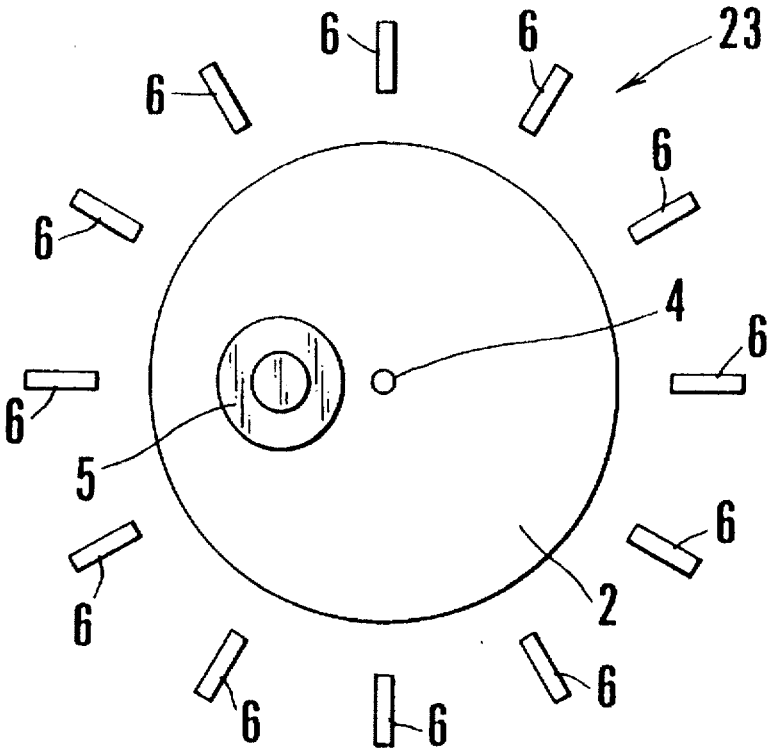
FIG. 9 is an view of a polishing apparatus according to the second embodiment of the present invention.

FIG. 9 is a plan view showing a polishing apparatus according to the second embodiment of the present invention. The difference between a polishing apparatus 23 according to the second embodiment and the polishing apparatus 22 according to the first embodiment described above resides in that the number of gas blow-off nozzles 6 which is four in the first embodiment is increased to twelve in the second embodiment. This can make almost circular the distribution of a polishing agent 3 on a polishing pad 1 (see FIG. 5) during polishing, thereby improving the polishing stability.

Figure 10:
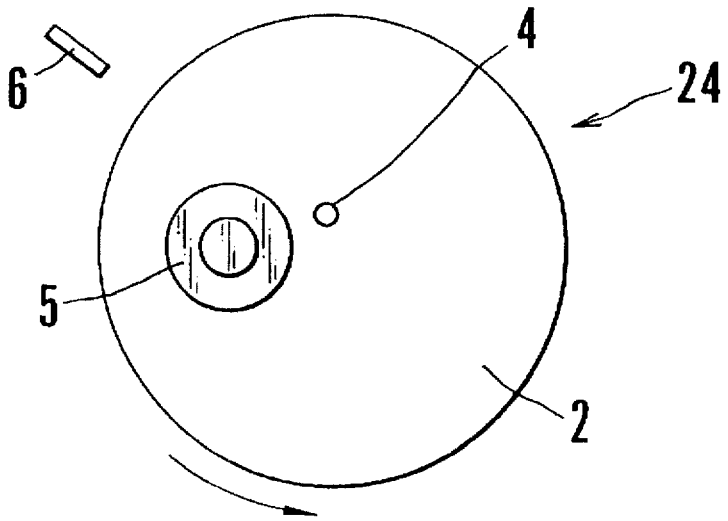
FIG. 10 is a plan view showing a polishing apparatus according to the third embodiment of the present invention.

FIG. 10 is a plan view showing a polishing apparatus according to the third embodiment of the present invention. In a polishing apparatus 24 of the third embodiment, the number of gas blow-off nozzles 6 which is four or more in the first or second embodiment described above is decreased to only one. In the third embodiment, although only one gas blow-off nozzle 6 is provided, since it is provided immediately before a wafer holding portion 5 in the rotational direction of a polishing table 2, a polishing agent 3 can be centralized to the wafer, so that a polishing effect equal to that in the conventional case can be obtained with a smaller flow rate of the polishing agent. Also, in this embodiment, the supply position of the polishing agent 3 from a polishing agent supply nozzle 4 is set slightly closer to the center of the polishing table 2 than on a concentric circle on the polishing table 2 where the center of a polishing target wafer is located. Then, spread of the polishing agent 3 caused by rotation of the polishing table 2 and a centrifugal force accompanying this rotation precisely covers a portion of the polishing table 2 where the wafer is located, thereby aiding the polishing agent 3 to be centralized on the portion of the polishing table 2 where the wafer is located.

In this embodiment, the shape of the gas blown from the gas blow-off nozzle 6 is not particularly explained. However, since the distal end portion of the gas blow-off nozzle 6 is generally circular, the shape of the gas blown from the gas blow-off nozzle 6 becomes a circular cone having the gas blow-off nozzle 6 as its vertex. If spread of the shape of gas which is blown is adjusted by changing the shape of the distal end of the gas blow-off nozzle 6, the effect of blowing can be changed. For example, if the opening portion of the gas blow-off nozzle 6 is flattened, the blown air can have the shape of a vertically collapsed conical shape. Hence, the blown air is centralized near the polishing table 2, thereby further increasing the effect of blowing. If a plurality of gas blow-off nozzles 6 are provided, as in the polishing apparatus 22 or 23 of the first or second embodiment, an adjusting means capable of adjusting the angle of nozzle may be provided to each blow-off nozzle 6, and the distribution of polishing agent 3 on the polishing table 2 may be optimized.

What we claim is:

1. A polishing method of polishing a surface of the wafer by pressing a wafer, which is rotating in the same direction as a polishing table, against said polishing table while continuously flowing a polishing agent onto said polishing table, comprising suppressing run-off of said polishing agent by continuously blowing air from an outside of said polishing table toward said polishing table.

2. A method according to claim 1, wherein distribution of said polishing agent on said polishing table is controlled by adjusting a flow rate of said polishing agent and a strength of air to be blown.

3. A method according to claim 1, wherein supply of said polishing agent onto said polishing table is started in advance, and pressing of the wafer against said polishing table and blowing of air are started almost simultaneously.

4. A wafer polishing apparatus comprising a polishing table having rotating means, polishing agent supplying means for supplying a polishing agent onto said polishing table, wafer holding means, having rotating means and a vertical drive mechanism, for holding a wafer to oppose said polishing table, and air blowing means for blowing air from an outside of said polishing table toward said polishing table.

5. An apparatus according to claim 4, wherein said air blowing means has blowing air amount control means and/or air blowing angle control means.

6. An apparatus according to claim 4, wherein said air blowing means has a blowing port with a distal end portion which is formed flat.

* * * * *